US011885595B2

(12) United States Patent
Beckman

(10) Patent No.: US 11,885,595 B2
(45) **Date of Patent: *Jan. 30, 2024**

(54) ADAPTIVE ARMOR IMPLEMENTED WITH ELECTROMAGNETIC FIELDS

(71) Applicant: Christopher V. Beckman, Los Angeles, CA (US)

(72) Inventor: Christopher V. Beckman, Los Angeles, CA (US)

( * ) Notice: Subject to any disclaimer, the term of this patent is extended or adjusted under 35 U.S.C. 154(b) by 61 days.

This patent is subject to a terminal disclaimer.

(21) Appl. No.: 17/107,888

(22) Filed: Nov. 30, 2020

(65) Prior Publication Data

US 2021/0341260 A1 Nov. 4, 2021

Related U.S. Application Data

(63) Continuation-in-part of application No. 16/525,557, filed on Jul. 29, 2019, now Pat. No. 10,850,815, which is a continuation-in-part of application No. 15/847,873, filed on Dec. 19, 2017, now Pat. No. 10,364,004, which is a continuation-in-part of application No. 14/923,422, filed on Oct. 26, 2015, now Pat. No. 9,846,006, which is a continuation-in-part of application No. 14/515,486, filed on Oct. 15, 2014, now Pat. No. 9,170,074, which is a continuation-in-part of application No. 13/656,707, filed on Oct. 20, 2012, now Pat. No. 8,875,433.

(51) Int. Cl.
*F41H 5/007* (2006.01)

(52) U.S. Cl.
CPC ..... *F41H 5/007* (2013.01)

(58) Field of Classification Search
CPC ..... F41H 5/007; F41H 5/12
See application file for complete search history.

(56) References Cited

U.S. PATENT DOCUMENTS

2012/0312149 A1* 12/2012 Marscher ..... F42B 12/46 89/930
2016/0273885 A1* 9/2016 Broussard, Jr. ..... G01S 17/66

* cited by examiner

*Primary Examiner* — J. Woodrow Eldred

(57) ABSTRACT

New devices, systems and methods are provided for protecting personnel and/or equipment from projectiles and other weapons. In some embodiments, a field of shielding particles or other interception media is activated on or about a location determined to intercept one or more projectile(s) or other physical threat(s). In some embodiments, electromagnets are included within such device(s) or system(s), for driving the interception media and/or projectiles away from the protected personnel and/or equipment. In some aspects of the invention, a control system using sensors with one or more sampling points are included, and determine the location and probable trajectory(ies) of an incoming projectile, and deploy the interception media to intercept the incoming projectile or other weapon.

20 Claims, 4 Drawing Sheets

ADAPTIVE ARMOR IMPLEMENTED WITH ELECTROMAGNETIC FIELDS

RELATED APPLICATION DATA

This application is a continuation-in-part of, and claims priority to, U.S. patent application Ser. No. 16/525,557, filed Jul. 29, 2019 (now U.S. Pat. No. 10,850,815), which is a continuation-in-part of U.S. patent application Ser. No. 15/847,873, filed Dec. 19, 2017 (now U.S. Pat. No. 10,364,004), which is a continuation-in-part of U.S. patent application Ser. No. 14/923,422, filed Oct. 26, 2015 (now U.S. Pat. No. 9,846,006), which is a continuation-in-part of U.S. patent application Ser. No. 14/515,486, filed Oct. 15, 2014 (now U.S. Pat. No. 9,170,074), which is a continuation-in-part of U.S. patent application Ser. No. 13/656,707, filed Oct. 20, 2012 (now U.S. Pat. No. 8,875,433), the entire contents of each of which applications are hereby incorporated herein by reference in their entirety as if fully set forth in the present application.

FIELD OF THE INVENTION

The present invention relates to the field of projectile and other weapons interceptors, armor and other protection equipment.

BACKGROUND

The inventive subject matter disclosed in this application, including applications incorporated by reference herein, relates to several technical fields, including devices used by the military, police and other first-responders to emergencies.

Armor has been used in warfare since the dawn of civilization, beginning with the use of animal hides, as demonstrated by some early artifacts recovered in the Philippines. See generally Stone, G. C., A Glossary of the Construction, Decoration and Use of Arms & Armor in All Countries and at All Times, at p. 22 and FIG. 82. In the copper, bronze and iron ages, metal armor plating was initiated, providing far greater protection against increasingly deadly weapons. In modern warfare, metal, ceramic and other armor plates are still used extensively in body armor, vehicles and stationary barriers. Body armor is standard issue for United States soldiers, and includes the use of protective plates to defeat small arms ammunition. See, e.g., Garamone, J., Body Armor Works, available at http://www.defense.gov/news/newsarticle.aspx?id=65076, accessed Oct. 10, 2014. Armored vehicles and barriers can be outfitted for protection against such small arms, and against larger-impact explosive weapons and projectiles, such as roadside bombs and IEDs. Insinna, V., National Defense, available at http://www.nationaldefensemagazine.org/blog/Lists/Posts/Post.aspx?ID=1633, accessed Oct. 10, 2014.

It should be understood that the disclosures in this application related to the background of the invention in, but not limited to, this section (titled "Background") are to aid readers in comprehending the invention, and are not necessarily prior art or other publicly known aspects affecting the application; instead the disclosures in this application related to the background of the invention may comprise details of the inventor's own discoveries, work and work results, including aspects of the present invention. Nothing in the disclosures related to the background of the invention is or should be construed as an admission related to prior art or the work of others prior to the conception or reduction to practice of the present invention.

SUMMARY OF THE INVENTIVE SUBJECT MATTER

The inventive subject matter set forth in the present application involves a number of varied technical areas, including, but not limited to systems, devices and methods for the protection of firearm users and other personnel and equipment from incoming projectiles and other weapons. In some embodiments, such systems and devices include a control system which creates and controls a field of (e.g., charged and/or ferromagnetic) particles or other interception media on or about a location determined to intercept one or more projectile(s) or other physical threat(s). In some embodiments, electromagnets are included within such device(s) or system(s). In some such embodiments, such electromagnets drive the interception media and/or projectiles away from the protected personnel and/or equipment. In some aspects of the invention, such a control system controls and communicates with sensors, and determines the location and probable trajectory(ies) of an incoming projectile. In some such embodiments, such sensors are provided at multiple different locations in a three-dimensional ("3D") environment. In some embodiments, such device(s) and system(s) deploy the interception media to intercept one or more incoming projectile(s) or other weapon(s). In some embodiments, such systems, devices and methods involve actuating, by launching or otherwise moving an interception media. For example, in some such embodiments, such launching or otherwise moving is achieved, at least in part, through electromagnetic force (e.g., with such interception media being electrically and/or magnetically charged, as with charged particles). As another example, in some embodiments, such launching or otherwise moving is achieved, at least in part, through a propellant. In some embodiments, such media reacts to the presence of a projectile (e.g., through a chemical reaction, or by applying a particular force against such a projectile.)

A wide variety projectile and weapon protection devices, systems and methods for their use, are provided. In some embodiments, a gun-mounted ballistic protection device is provided, comprising one or more interception media launcher(s) protecting a user's vital organs from incoming projectiles. In some embodiments, a user may activate the protection device with a partial trigger pull, or a button placed within reach of a user's trigger finger. In some aspects of the invention, a control system using a microphone or other sensor(s) with multiple sampling points in a forward location, determine the location and trajectory of an incoming projectile, and deploy interception media to intercept the incoming projectile. In some embodiments, an at least partially vehicle-mounted device is provided, and such media launcher(s) may be provided on or about a vehicle in some such embodiments. In some embodiments, an at least partially terrain-mounted device is provided, and such media launcher(s) may be provided on or about terrain of surrounding environment in some such embodiments. In some embodiments, an at least partially airborne device is provided, and such media launcher(s) may be provided on or about an aircraft (e.g., a UAV), in some such embodiments.

It should be understood that, for convenience and readability, this application may set forth particular pronouns and other linguistic qualifiers of various specific gender and number, but, where this occurs, all other logically possible gender and number alternatives should also be read in as both conjunctive and alternative statements, as if equally, separately set forth therein.

DETAILED DESCRIPTION OF THE INVENTION

Figure 1:
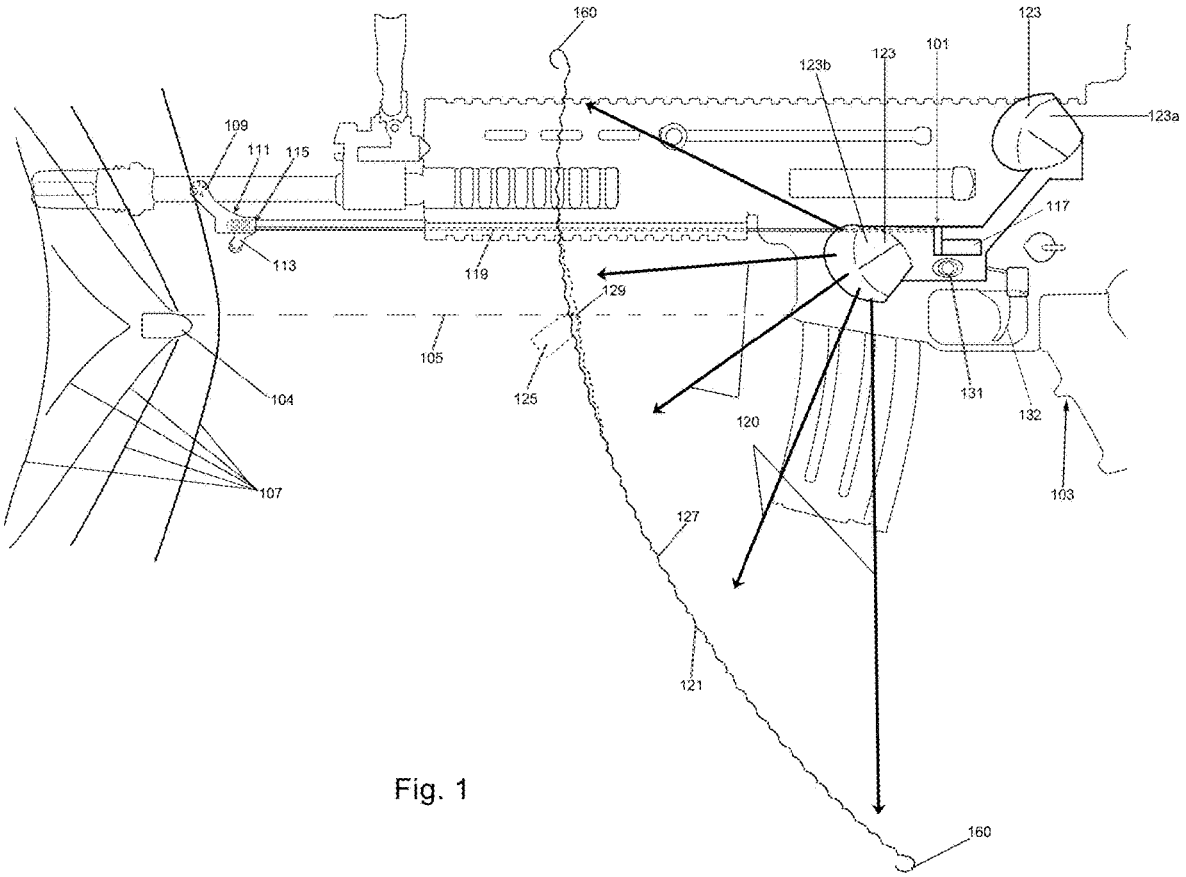
FIG. 1 is a side view depicting aspects of an example projectile-blocking system, comprising a projectile-blocking device mounted on a firearm, according to some embodiments.

FIG. 1 is a side view depicting aspects of a projectile blocking system, comprising an example projectile-blocking device 101, mounted on an example firearm 103, in accordance with some embodiments of some inventions set forth in this application. Preferably, projectile-blocking device 101 is mounted on firearm 103, at a location selected not to interfere, or to minimally interfere, with the ordinary operation of firearm 103. But the mounting location and configuration is also preferably selected to present user controls in easily, intuitively accessible locations, to control the functions of projectile-blocking device 101, and conduct systems and methods in accordance with aspects of the present invention, which will be set forth in greater detail below.

Also pictured in the figure is a bullet 104, traveling from the left-hand side of the figure, and toward the right-hand side, along an initial projectile path 105. A pattern of sound waves, and/or other air disturbance, depicted as compression waves 107, and a distinctive pattern thereof, which emanates from, and is shown around, bullet 104 at an instant as it travels through the air along path 105. The instant at which bullet 104 and waves 107 are pictured is the point in time when waves 107 reach a first sensing section 109 of a specialized sensor that senses the presence and/or location of a projectile or other weapon. In some embodiments, such a specialized sensor is or includes a location-tracking sensor 115, which includes a headpiece 111. In some embodiments, such a location-tracking sensor 115 includes a microphone, for sensing compression waves such as waves 107. In some embodiments, location-tracking sensor 115 includes RADAR hardware. In some embodiments, location-tracking sensor 115 includes LIDAR hardware. In some embodiments, location-tracking sensor 115 includes a camera. In some embodiments, location-tracking sensor 115 includes an infra-red (IR) sensor. In some embodiments, location-tracking sensor 115 includes another form of projectile detecting hardware known in the art. After some of waves 107 reach and pass by first sensing section 109, other parts of waves 107 will then reach a second sensing section 113 of location-tracking sensor 115, located farther away from the firing source of the bullet (not pictured within the view, but on the left-hand side of the figure) than first sensing section 109. As will be explained in greater detail below, in reference to FIG. 2, in some embodiments, first sensing section 109 and/or second sensing section 113 comprise a hollow housing. In some such embodiments, such a hollow housing comprises holes, facilitating the entry of compression waves (e.g., sound). In some embodiments, such a hollow housing comprises a differential medium, to aid projectile-blocking device 101 in distinguishing between sound or other waves entering first sensing section 109 and second sensing section 113. In some such embodiments, location-tracking sensor 115, in conjunction with a computer unit 117 including or included within it (which may be a control system such as example control system 400, set forth below), may determine a time when such waves arrived at first sensing section 109, and determine and compare a different time when such waves arrived at a second sensing section 113, due to differences in the waves caused by the different materials held within first sensing section 109 and second sensing section 113 through which the waves passed at those times. Based on that information, the control system may then determine a probable speed, location and interception path, for intercepting bullet 104 by launching an interception media, in some embodiments. Of course, this particular projectile tracking system and method is just one example of the many possible projectile tracking systems that may be used, instead of or in addition to, this particular projectile tracking system. As another example, in some embodiments, the control system may determine a location(s), and projected location(s), of bullet 104 (or any other projectile) based on RADAR, LIDAR, camera, IR, or other known forms of projectile sensing and tracking, as will be readily apparent to those of skill in the art.

In some embodiments, headpiece 111 is mounted on location-tracking sensor 115, which, in some embodiments, is wired or otherwise capable of communicating with a control system, such as example computer unit 117, comprised in device 101. Example communication wires 119 are one such possible wiring configuration, which may be preferred in some embodiments to aid in transmitting high speed information between location-tracking sensor 115 and computer unit 117, without the need for separate power sources, computer hardware and antennas within location-tracking sensor 115 and computer unit 117, and without interference and other wireless signal transmission issues. However, it should be understood that a wide variety of other, alternative communications configurations and embodiments may be implemented instead of or in addition to that pictured, and some of such configurations and embodiments may have some advantages. For example, a wireless transmission method may be accomplished without a separate, additional local computer comprised within location-tracking sensor 115, if location-tracking sensor 115 is directly connected to a transmitter that transmits wireless signal(s) generated from location-tracking sensor 115 directly to computer unit 117. In addition, a wireless transmission method may be preferred for maximizing the speed of the transmitted signal, because electromagnetic radiation through air is considerably faster than the speed of electronic signals over wires. Either approach, or variations and combinations of them, or other approaches, may be used, however, while still carrying out aspects of the present invention. Wireless and wired signal transmission speeds, in conjunction with the speed of the computer hardware implementing other aspects of the invention required for intercepting a projectile, and the speed of launching an interception media, such as example interception media 121 (as will be discussed below), can exceed the speed of a projectile such as bullet 104, the detection and tracking of which may serve as the basis for actuating such an interception media, in accordance with some embodiments.

In some embodiments, the signals transmitted from location-tracking sensor 115 are received as input in computer unit 117, which, in some embodiments, is specialized and configured to analyze sensed wave patterns and create different resulting signals related to sounds or other compression waves captured by first sensing section 109 and second sensing section 113, in some embodiments, due to the differing filtering media (as will be discussed in greater detail below). In some embodiments, by receiving such signals, and interpreting how they differ from one another, and how they change over time, and identifying signal models corresponding with bullet speeds and locations, the computer unit 117 is able to rapidly determine a location, flight path and interception path for bullet 104, for example, using configurations and programming set forth below with reference to FIG. 3. In some embodiment, first sensing section 109 is located not only further toward the muzzle of firearm 103 than second sensing section 113, but also at a higher location vertically, with differing internal reflections and muffling effects that change depending on the location and flight path of a ballistic source of sound. In some embodiments, libraries of different ballistic trajectories related with different sound characteristics for particular sensor hardware, such as headpiece 111 and location-tracking sensor 115 (and an asset on which it is mounted, and other environmental conditions assessed to be present) are rapidly matched to live data from location-tracking sensor 115 by the computer unit 117. In some embodiments, derived relationships (which may be mathematically expressed) between sensed characteristics and related projectile trajectories may also, or instead, be applied to signals received in computer unit 117 from location-tracking sensor 115 to determine a probable flight path for a projectile source of the sound. If the matched sound and/or characteristics and a flight path or trajectory (or probably flight path or range of possible or probable flight path/trajectories) matched thereto for particular sensors, wave phenomena, or other sensed phenomena as input received in computer unit 117 indicates a bullet flight path or trajectory with a high probability of collision with the firearm user or other person or asset, the computer unit 117 then transmits a triggering signal to an interception media actuator, in some embodiments. In some embodiments, such an actuator includes an electronic detonator for a propellant. In some embodiments, such an actuator includes an electrically-actuated compressed gas release valve (or another propellant initiator). In some embodiments, such an actuator is located within, on or about, and/or includes, at least one of interception media actuation unit(s) 123. Preferably, such a transmitted triggering/detonating signal is timed to account for significant factors related to the projectile's present position, trajectory over time and, in particular, to cause a maximally effective interception of the projectile with a planned interception path of interception media launched from interception media actuation unit(s) 123. In some embodiments, these factors include sound or other wave transmission speeds and distances (or probable ranges thereof) from the projectile source to location-tracking sensor 115. In some embodiments, these factors include the distance and signal transmission speeds between computer unit 117 and location-tracking sensor 115. In some embodiments, these factors include the processing and transmission speeds and conduction distances for computer unit 117 carrying out all operations necessary to process those signals and trigger interception media actuation unit(s) 123. In some embodiments, these factors include the distance of the projectile from at least one interception media actuation unit selected for actuating media to intercept the projectile at the time of planned interception, and the launching acceleration and speeds (or probable, ranges thereof) of launched interception media along the planned path to intercept the projectile.

It should be understood that, although an embodiment using a single location-tracking sensor 115 is shown, different sensors, such as cameras sensing electromagnetic radiation from a projectile (or other sensors), and image, image sequences or other sensory library and expression or characteristics recordings matched with projectiles and flight paths, may, alternatively, or in addition, be used by the projectile-blocking device 101 to assess a flight path or probably trajectory of a projectile, and plan interception with an interception media. In some embodiments, multiple sensors may be used, rather than the single location-tracking sensor 115 pictured. Embodiments with additional sensing sections, additional differential media and/or additional sensors, may be implemented. In some embodiments, an actuable, moving sensor, may be used. In some such embodiments, such a moving sensor may more accurately assess a projectile location and trajectory (for example, implementing triangulation methods to determine the location of the projectile as a source of sound or other wave phenomena).

Interception media actuation unit(s) 123 may comprise one or more ballistic projectile interception media (or, in some embodiments, other projectile interception media), such as that shown deployed as example interception media 121. In some embodiments, prior to deployment, such interception media is packed far more tightly in each of interception media actuation unit(s) 123 than after launch, and held at a location within interception media actuation unit(s) 123 outward from a propellant (such as a fast-burning, explosive solid fuel with integrated oxidizer, held deeper within interception media actuation unit(s) 123, in some embodiments). Preferably, in some embodiments, a fast-burning solid fuel or expanding gas is released, ignited, or otherwise triggered within interception media actuation unit(s) 123 to propel and expand the interception media 121, into a position such as that pictured. Thus, the computer unit 117 is able to rapidly trigger and deploy projectile interception media 121, expanding and launching it as shown by expansion/launch direction arrows 120, and intercept bullet 104, as shown at a secondary (intercepted) bullet position 125.

In some embodiments, projectile interception media 121 takes the preferred form of a folded sheet or blanket of ballistic projectile-resistant material, such as, but not limited to, KEVLAR. Also preferably, in some embodiments, projectile interception media 121 resists the flow of air through it, in the forward direction (meaning a direction toward bullet 104, and at least partially opposite to the direction of travel of bullet 104), and, in some embodiments, projectile interception media 121 also preferably comprises projectile path and attitude altering surface features, such as the structures and contours shown as structures 127. Thus, as bullet 104 collides with projectile interception media 121, bullet 104's tip encounters and is pushed by one of such structures—namely contour 129, causing the bullet 104 to pitch upward. In some embodiments, some of such structures—namely, outer catches 160—are specialized for holding an intercepted projectile, and preventing its "running off" or otherwise escaping from the interception media altogether. Preferably, projectile interception media 121 also comprises kinetic energy dispersing and surface area widening sub-features and structures, such that projectile interception media 121 prevents or decreases damage to an object on the other side of it from a projectile it is intercepting, in the event of a collision. Also preferably, such energy dispersing and surface area widening sub-features and structures are flexible, and foldable, allowing projectile interception media 121 to be flexibly molded, but cause binding (e.g., with fibers that interlock in reaction to ballistic forces) to enhance that effect. Furthermore, the overall outline of the deployed projectile interception media 121 is curved, in some embodiments, further causing bullet 104 to be pushed lower, deviating downward from its initial projectile path 105. Overall, these aspects, in conjunction with air resistance against projectile interception media 121, create a tumbling, kinetic energy-absorbing effect on bullet 104 at position 125, greatly decreasing its kinetic energy and lowering its flight path. It should be understood that projectile interception media 121 is pictured in a partial cross-section, for simplicity of illustration, and appears to be 2-dimensional as a result, but that, in a preferred embodiment, is actually 3-dimensional ("3D") and covers a wide area surrounding the user. In some such embodiments, projectile interception media 121 also curves inward, toward the user and butt of firearm 103, as one proceeds upward, out of the page, in the perspective of the figure, thus also pushing an intercepted bullet away, and to the side of a user, in that direction. Similarly, although structures 127 are shown in cross-section as having 2-dimensionally-depicted curves, it should be understood that they are preferably include 3-dimensional, scooping contours, and grip, control and intercept a projectile colliding with it from a wide variety of directions, over a wide area.

Firearm 103 and projectile-blocking device 101, are pictured in an example embodiment including a configuration optimal for a left-handed user, such that the user's left hand may grip the handle of firearm 103, and her left index finger may access a projectile-blocking device activation control 131. In addition, in some embodiments, as pictured, the interception media actuation unit(s) 123 cover areas of the user more exposed to projectiles, on one side of firearm 103. In some embodiments, however, the interception media actuation unit(s) 123 may be provided on multiple sides of a user or other asset, such as a valuable device(s) (which device(s) may include, but are not limited to, firearm 103). Thus, although firearm 103 comprises an armored housing, interception media actuation unit(s) 123 fortify firearm 103's armor by moving interception media (e.g., particles) onto, around, or about that armored housing, in some embodiments. For example, in some embodiments, interception media actuation unit(s) 123 may also be included in projectile-blocking device 101 on the right-hand side of firearm 103. In some embodiments, interception media actuation unit(s) 123 may be shaped to provide a shaped interception media, aimed to result in coverage matching areas not covered by firearm 103 and/or a user's arm. This embodiment has the added benefit of avoiding errant collisions of projectile interception media 121 with the user's forearm. It should be understood that the various coverage scenarios, mounting positions and sensor locations are examples only, and that a wide variety of alternative or additional scenarios, positions and locations may be implemented while carrying out aspects of the present invention. For example, some embodiments may have ground-mounted interception media launchers, and sensors placed several hundred yards forward from a user's or other protected asset's position, while carrying out aspects of the present invention.

If, by contrast, the computer unit 117 determines that bullet 104 has a projected flight path that is higher than that pictured (e.g., with too high a probability of intersecting with a user's head, chest or shoulders), an upper interception media actuation unit 123*a* may, instead, be deployed (not pictured). In that instance, the deployed media would take on a similar shape to that pictured as projectile interception media 121, but with a much higher profile, facing upward more, and deflecting the flight path of the intercepted bullet upward, rather than downward.

In some embodiments, each interception media actuation unit(s) 123 may launch a series of layered intercepting media instances, which each may be launched with separately-triggered propellants, in some embodiments. In some such embodiments, such a projectile-blocking device 101 may be actuated multiple times, intercepting several projectiles or other weapons, such as bullet 104 presenting a danger for the firearm user, before a unit needs to be refurbished or replaced for further operation. In a preferred embodiment, interception media actuation unit(s) 123 are rapidly exchangeable with similar, other interception media actuation unit(s), which may be stored separately (not pictured). In some such embodiments, such other interception media actuation unit(s) include touch-based electrical contacts that allow a user to connect and disconnect simultaneously with fastening/unfastening mounting hardware for variably connecting such fungible interception media actuation unit(s) to the remainder of projectile-blocking device 101. In this way, a surplus of such other interception media actuation unit(s) may be kept on hand, and rapidly exchanged for depleted interception media actuation unit(s) 123 (if and when, depending on the embodiment, any and all (e.g., propellant; spring-loading; electromagnetic; electrostatic; and/or magnetic) interception media moving actuators, and/or other forms of interception media moving actuators, have been drained of stored power, and/or interception media stored within the interception media actuation unit(s) 123 have been eliminated from a storage area, and moved to an actuation target area).

Although the example of a thin, tightly-packed blanket of a ballistic projectile interception media 121 is provided, it should be understood that a wide variety of different forms of intercepting media may be used—alternately, or in conjunction, and with or without the form of projectile interception media 121 pictured. For example, in some embodiments, a 3D balloon of media, holding a gas, rather than a blanket, may be launched or otherwise moved by such propellant, spring-loading, electromagnetic, electrostatic, or magnetic actuators. In some embodiments, interception media includes any suitable material(s) or substance(s) for blocking, intercepting, reducing the kinetic energy of, sequestering, widening and/or dispersing the energy of and/or diverting a projectile or other weapon, such as example bullet 104. As another example, in some embodiments, a distributed liquid, gel, fluid and/or a sticky or malleable substance (such as glue) may be so launched or otherwise moved, to block, intercept, reduce the kinetic energy of, sequester, widen and disperse the energy of and/or divert a projectile or other weapon, such as example bullet 104. In yet another example of the virtually unlimited number of embodiments, one or more (e.g., a field) of particles (a.k.a., "shielding particles") may be so launched or otherwise moved, to block, intercept, reduce the kinetic energy of, sequester, widen and disperse the energy of and/or divert a projectile or other weapon, such as example bullet 104. In some such embodiments, such particles may have an electrostatic charge(s) or dipole(s), and/or may be ferromagnetic, allowing an electromagnetic, electrostatic and/or magnetic actuator included in interception media actuation unit(s) 123 to direct and/or move such particles to affect sensed projectiles. In some such embodiments, interception media actuation unit(s) 123 may project interception media at an angle which results in interception media colliding with bullet 125 predominantly laterally relative to its flight path during interception, to primarily cause bullet 125 to be diverted around a user. In some such embodiments, such an angle may be selected to more greatly alter the flight path of bullet 125, rather than primarily to absorb its energy. In some embodiments, which incorporate electromagnetic, electrostatic and/or magnetic actuators within projectile-blocking device 101, a force field, such as a magnetic field generated from a strong electromagnet may be implemented to divert the bullet's flight path, rather than a physical media. In some embodiments, shielding particles may include any suitable material for reducing or altering the velocity of a projectile or other weapon upon impact with it. For example, in various embodiments, shielding particles include any, some or all of the following materials: a metal, iron, steel, nickel, titanium, a fabric, a woven fabric, KEVLAR, TWARON, DYNEEMA, CORDURA, nylon, carbon, carbon fiber, graphene, a ceramic, silk, a plastic, polyethylene (a.k.a. "PET") (such as high molecular weight PET), polyurea, gel-spun materials, and/or fibrous, layered and/or mesh and/or other structures including any or all of the foregoing). In some embodiments, a smaller, intercepting projectile, which may include any of the materials set forth above for shielding particles, may be launched from one of, and/or part of interception media actuation unit(s) 123, which may further comprise aiming actuators (e.g., servos controlled by computer unit 117) for altering the path of the intercepting projectile when it is launched, and computer unit 117 may control those aiming actuators to cause the launched intercepting projectile to intercept, collide with and/or sequester bullet 104 (based in part on a determination of bullet 104's location, flight path and trajectory over time, as discussed above). In some such embodiments, computer unit 117 may include a ballistic computer or other projectile-tracking and flight-predicting computer. In some embodiments, a control system external to computer unit 117, but in communication with computer unit 117, may include such a ballistic computer. In any event, in some embodiments, such a ballistic computer may track and calculate paths of movement of projectiles or other weapons which may create a threat of impact with a user, or device or other valuable asset, and communicate signals related to such a threat to the remainder of computer unit 117, and based upon which signals, computer unit 117 may actuate interception media actuation unit(s) 123. The precise examples disclosed and set forth herein are preferred, but not exhaustive of the many possibilities, each of which may have some distinct advantages over others, that fall within the scope of the invention.

In some of the embodiments set forth above comprising an expanded blanket or net of interception media, a wide variety of different materials and designs may also be used. For example, some embodiments of such interception media may include extremely light, strong and/or flexible materials (such as any, some or all of the following materials: a metal, iron, steel, nickel, titanium, a fabric, a woven fabric, KEVLAR, TWARON, DYNEEMA, CORDURA, nylon, carbon, carbon fiber, graphene, a ceramic, silk, a plastic, PET (such as high molecular weight PET), polyurea, gel-spun materials, and/or fibrous, layered and/or mesh and/or other structures including any or all of the foregoing). In some embodiments, such a blanket or net is air-tight or air resistant, creating drag against the atmosphere when a projectile collides with it. Some embodiments of interception media may use a media that is not bullet-proof, or not fully bulletproof, but relatively cheap to produce, and effective at diverting the paths of ballistic projectiles, and reducing their lethality.

To save energy, and to reduce the likelihood or impact of a false positive match between sound sensor or other sensor-related signals interpreted by the computer unit 117 and data related to models, expressions or other recordings associated with a probable flight path of a projectile requiring protection of a firearm user (stored in a databank, such as a library, within computer unit 117), system activation control(s), such as example digitally manipulated system activation control(s) 131 and/or auxiliary digitally manipulated system activation control(s) 133 may be provided. In some embodiments, digitally manipulated system activation control(s) 131 and/or auxiliary digitally manipulated system activation control(s) 133 facilitate a user quickly and easily activating projectile-blocking device 101, such that it is activated (i.e., switched into a powered on, active or other state in which it is able to carry out the sound, wave and/or other sensed phenomena interpretation, projectile flight path determination and/or projectile interception methods set forth in this application). Either or both of digitally manipulated system activation control(s) 131 and/or auxiliary digitally manipulated system activation control(s) 133, or another form of system activation control, may be included in some embodiments. In some such embodiments, any part of projectile-blocking ballistic protection device 101 may be activated (e.g., as discussed above and/or by providing power, configuring or otherwise readying device to operate and intercept incoming projectiles posing a probable threat to the user) when a user actuates digitally manipulated system activation control(s) 131 and/or auxiliary digitally manipulated system activation control(s) 133, or another form of user-actuable control (e.g., touchscreen displays including a GUI). In some such embodiments, which are preferred, the entire projectile-blocking device 101 remains powered down, or in a standby state, using no power or minimal ("standby") power for only part of its circuits related to switching projectile-blocking device 101 between standby and more active states, unless and until a user depresses a system activation control. In various embodiments, such system activation controls include: digitally manipulated system activation control(s) 131 (a button) with his or her index finger; and/or auxiliary digitally manipulated system activation control(s) 133; and/or unless and until a user partially depresses firearm trigger 132 or releases a firearm safety device. In some method-of-use embodiments, any of those embodiments of activation controls discussed above, and possible combinations thereof, projectile-blocking device 101 is activated on-demand, as the user encounters a potentially dangerous engagement scenario that may improve due to the use of the protection afforded by projectile-blocking device 101. For example, if a police officer is engaging an armed suspect who, although dangerous to the officer, has not yet fired a weapon, or otherwise threatened deadly force warranting the officer's firing in self defense, the officer can still take measures to protect herself and, in some embodiments (in which interception media actuation unit(s) 123 cover others near the firearm user) other persons or assets from the possibility of such or other force, by activating projectile-blocking device 101 while training her firearm at the suspect. If and when a suspect were to suddenly fire a firearm at the police officer, projectile-blocking device 101 then serves to protect the officer and, potentially, other persons, according to the methods discussed in this application.

In some embodiments, system activation control(s) 131 is preferably isolated from firearm trigger 132, but placed near enough to the natural placement of a user's index finger on firearm 103 that it may be accessed without the user having to reposition his or her hand when holding firearm 103's hand grip. Thus, a user can rapidly activate projectile-blocking device 101 at any time, and move quickly between firearm firing and projectile-blocking protection options, using projectile-blocking device 101, and remain ready for multiple forms of necessary engagement, depending on the scenario she encounters. In some embodiments, auxiliary digitally manipulated system activation control(s) 133 is even more easily, and, in at least some sense, passively engaged, under some circumstances. In some embodiments, auxiliary digitally manipulated system activation control(s) 133 is mounted on or near firearm trigger 132, and includes a sensor sensing when it is partially compressed, activating projectile-blocking device 101 as discussed above based on such sensing. In some embodiments, auxiliary digitally manipulated system activation control(s) 133 is so mounted and disposed to sense when a finger is placed near it (e.g., on or within its trigger-guard), activating projectile-blocking device 101 as discussed above based on such sensing. In some embodiments, auxiliary digitally manipulated system activation control(s) 133 includes a trigger movement sensor, sensing when trigger 132 of the firearm is moved (even partially), activating projectile-blocking device 101 as discussed above based on such sensing. Thus, in any of the embodiments discussed above, when trigger 132 is partially depressed (for example, to release a trigger-mounted safety such as those used in GLOCK pistols), projectile-blocking device 101 and/or its computer unit or power supply (not pictured) may be powered on and engaged, or otherwise activated, to ready projectile-blocking device 101 and place it in a condition for immediate operation. In this way, when a user applies pressure to trigger 132, or otherwise indicates a likelihood of an engagement with a violent adversary, projectile-blocking device 101 becomes activated. In a preferred embodiment, auxiliary digitally manipulated system activation control(s) 133 is used in conjunction with a master activation switch (e.g., placed in the position of system activation control(s) 131) and does not operate to activate projectile-blocking device 101 unless and until that master activation switch is first switched on. Even more preferably, such a master activation switch does not require constant active pressure to remain on, unlike preferred embodiments of system activation control(s) 131, when used alone, which preferably do require active pressure, but remain active for a period following that pressure, for sustained user safety in the event of surprise events.

Figure 2:
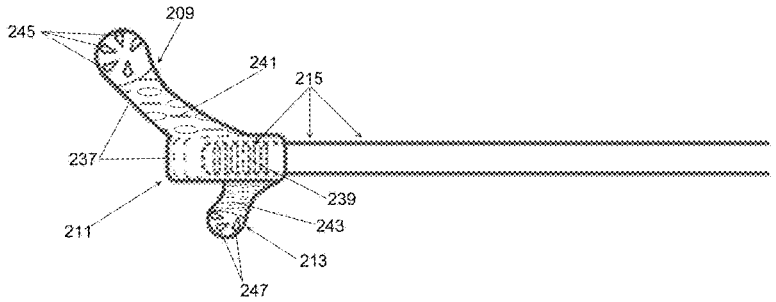
FIG. 2 is an enlarged view of an exemplary specialized location-tracking sensor and headpiece of the projectile-blocking device discussed with reference to FIG. 1, above.

FIG. 2 is an enlarged view of an example specialized, location-tracking sensor 215 and headpiece 211 of the projectile-blocking device 101 discussed in reference to FIG. 1, above, according to some embodiments. As discussed above, in reference to FIG. 2, in some embodiments, headpiece 211 comprises at least two sound- or other wave-phenomena receiving sections: now shown as a first sensing section 209 and second sensing section 213. Also as discussed above, in some embodiments, headpiece 211, and first sensing section 209 and second sensing section 213, are at least partially hollowed out, as demonstrated by the limited thickness of example hollow housing 237. In some such embodiments, this hollowed-out design allows the insertion of location-tracking sensor 215 into, and the mounting of, headpiece 211, with the added advantage of reduced weight and distinctive channeling of sound or other waves inside headpiece 211 toward an electronically-sensed diaphragm or other sensing instrument 239 of location-tracking sensor 215, originating from different intake locations of first sensing section 209 and second sensing section 213.

In some embodiments, as sound or other waves reach first sensing section 209 and second sensing section 213, they each enter a different space (namely, a first space 241 and a second space 243, respectively) via different holes (namely, first set of holes 245 and second set of holes 247, respectively). In some embodiments, first space 241 and second space 243 may be differently contoured, surface-lined, and/or filled with distinctive filtering and/or lens materials, such that substantially the same originating sounds or other waves entering first set of holes 245 and second set of holes 247 may thus be divided into multiple new sets of sounds or other waves, then distinguished as having entered and passed through either first space 241 or second space 243, after reaching sensing instrument 239. For example, the larger shape and more gradual curve of first space 241, or different linings, in comparison to those of second space 243, may yield a lower or otherwise different tone, echoes, or other reflections, or wave conduction, in comparison to the tones, reflections and conduction of second space 243. As another example, in some embodiments, first space 241 may be filled with an acoustic material that mutes particular high-frequency sound waves, while second space 243 is filled with an acoustic filtration material that retains such high-frequency sound waves, while muting other frequency ranges. In this way, a computer system (such as computer unit 117, which may be, include, or be included within any of the computer system embodiments discussed elsewhere in this application) receiving a signal from location-tracking sensor 215 is able to determine when the same originating sound or other wave reached first sensing section 209 and second sensing section 213, and, by comparing the sound or other wave patterns to models of sound emanating from projectiles through the same headpiece 211, the computer system may determine a probable location, velocity, and flight path for a projectile creating that sound or other wave. In some embodiments, some such models may also reflect differing source locations, velocities and resulting flight paths, as determined by different conduction of sound from different source locations through the housing of first sensing section 209 and second sensing section 213, and, in some embodiments, the regionally-varying housing thickness 237 (and regionally varying shapes or materials, if used in a particular embodiment). In some embodiments, by recording a library of different possible ballistic and other wave-producing projectiles under different atmospheric and other environmental conditions, such models are built by recording, averaging, and deriving characteristics associated with projectiles of different types, traveling at different speeds, and with different trajectories—some of which may be identified by the computer system as threatening the safety of a user, for example, being associated with a likelihood of endangering vital organs of a user (with a trajectory colliding with a likely location on a user of the ballistic protection system comprising location-tracking sensor 215. Alternatively, or in addition, in some embodiments, a direct comparison and matching to recorded sound patterns in such a library may be carried out by control unit 117, to match a presently signal(s) from location-tracking sensor 215 with an associated probable projectile trajectory, and determine and carry out a safe deployment of an intercepting media or material, as discussed above.

Although the embodiment of a single microphone or sensor, with multiple, distinguishing pathways at different spatial positions, has been used, it should be understood that multiple microphones and/or other sensors at multiple positions, and a wide variety of wave-detection or other detection sensors may, instead or in addition, be implemented in various particular embodiments. For example, embodiments may be implemented using a camera, or multiple cameras, (with or without an illuminator, but preferably with—e.g., using a LIDAR system) to observe an incoming projectile, and provide information to the control system such that it may plot a probable flight path for the projectile, determine if it poses an unacceptable risk to the user, and intercept it. In such an embodiment, there is the advantage of earlier information gathering and processing, because the electromagnetic radiation cast from the projectile moves at the speed of light, rather than the speed of sound.

Figure 3:
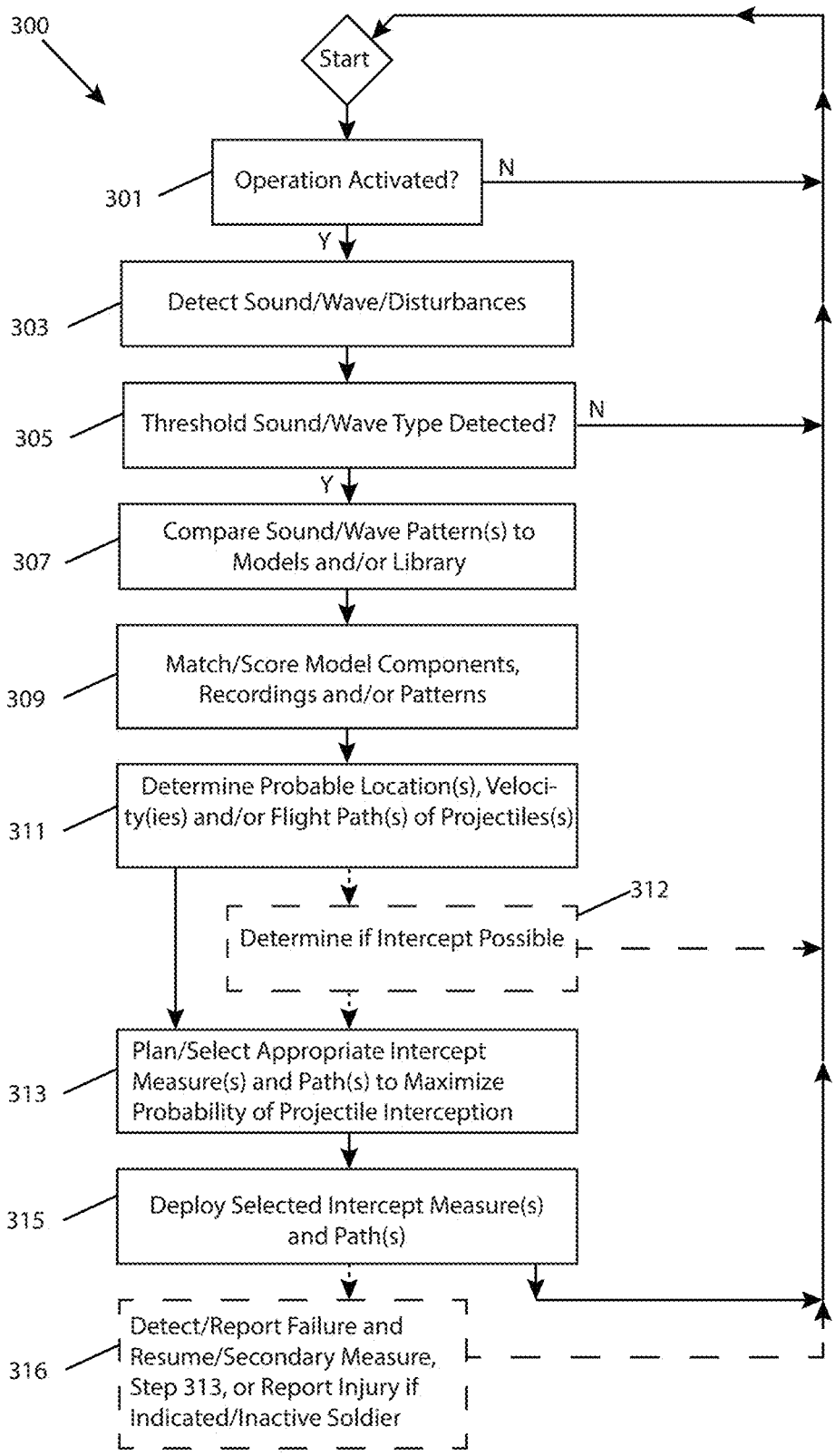
FIG. 3 is a process flow diagram depicting exemplary steps that may be executed by a control system implementing exemplary programming, methodology and other aspects of the present invention.

FIG. 3 is a process flow diagram depicting exemplary steps 300 to be executed by a control system implementing exemplary programming, methodology and other aspects of the present invention, such as computer unit 117 and/or control system 400, discussed below, carrying out aspects related to projectile protection devices and methods. Beginning with step 301, the system first determines, if possible (e.g., using a local power source), whether its operations have been activated, if a power source necessary for its operation has been connected, or if the associated projectile protection device has otherwise been configured to operate and intercept incoming projectile(s). For example, if a system activation control, such as digitally manipulated system activation control(s) 131 and/or auxiliary digitally manipulated system activation control(s) 133, have been actuated as described above, the control system may determine to activate further operations, receive power for operation, and/or determine to activate projectile interception-related operations. If those system operations have not been activated, or if the protection device has not otherwise been activated, the control system returns to the starting position.

If such activation has taken place, in some embodiments, the control system proceeds to step 303, in which it powers and/or receives signals from at least one microphone or other sensor(s), such as location-tracking sensor 115 and headpiece 111, and/or any of the alternate embodiments of projectile/weapon observational sensor types, discussed above. In some embodiments, in subsequent step 305, the control system may pre-process that signal, to determine whether it exceeds a threshold or thresholds of characteristics indicating a potential danger from a projectile, warranting further processing. For example, if the signal does not indicate (based on comparisons to data within a library, as discussed above) a sufficient wave amplitude emanating from a ballistic projectile, or near enough to the user to pose a danger, the system may determine that no further processing or consideration of the signal is then required, and return to the starting position. If the signal may indicate a potential danger from a projectile, however, in some embodiments, the control system proceeds to step 307, in which it compares the signal, or attribute or aspects of it or related to it, to models, characteristics or library recordings associated with particular or probable locations, velocities and/or flight paths of projectiles relative to a device comprising the control system. Next, in some embodiments, the control system may match, or attempt to match the signal or attribute or aspects of it or related to it, to those models, characteristics or library recordings, in step 309. Based on that matching activity, or on conclusions based on that matching (e.g., if similar enough to yield a possible projectile flight path or range of flight paths, create an average flight path associated with close matches) the control system may then determine and/or project probable location(s), velocity(ies) and/or flight paths (or a range thereof) of a detected projectile being tracked by the control system, in step 311. In some embodiments, as discussed above, such projected and/or probable flight paths may be determined with the aid of a ballistics computer, which may also factor in effects on a projectile's flight path from environmental conditions (e.g., wind, temperature, air density). In some embodiments, in a step, 312, the control system may then make a preliminary determination as to whether it is possible for the control system to intercept, divert or sequester the projectile using interception media, or other devices and techniques for diversion, sequestration and interception set forth in this application, if present in a projectile-blocking device comprising the control system (e.g., a device such as projectile-blocking device 101). In some such embodiments, the control system may return to the starting position if it determines that it is not possible to intercept, divert or sequester the projectile, thereby saving power or other resources and avoiding other undesired contingencies from further actions with respect to the projectile.

In some embodiments, if the control system determines that it is possible to intercept, divert or sequester the projectile, or if step 312 is omitted, the control system proceeds to step 313, in which it proceeds to map, plan or otherwise select or determine projectile interception measures to be taken, and along what interception media movement pathway, for example, by selecting an interception media actuator (and in some embodiments, aiming it, if an aimable interception media actuator is used) and, in some embodiments, selecting the actuation of interception media or other countermeasures, such as example interception media 121, discussed above. The control system preferably selects such countermeasures and interception media movement paths to maximize the probability that a projectile will be intercepted, sequestered, diverted or otherwise rendered less harmful or less potentially harmful. Following that determination, the control system then proceeds to step 315, in which it actuates, or causes the actuation of, the selected or determined interception measures, according to the planned movement path(s). Finally, in some embodiments, the control system may carry out an additional step 316, in which the control system detects and/or reports any failure of the measures taken in step 315, and may further deploy additional, supplemental measures to intercept, divert or sequester the projectile. In some embodiments, these measures may include spraying, coating or covering the user, or a part of the user's body projected to collide, or to have a high probability of colliding, with the projectile, with a further interception media. In some embodiments, in step 316, additional, supplemental measures to intercept, divert or sequester the projectile are implemented further away from the projectile than the initial planned interception path and measures, buying more time by acting further along the projectile's path. In some embodiments, detection of such a failure may be made by a signaled or otherwise detected breach or failed collision with the projectile (e.g., by electromagnetic scan carried out by a LIDAR gun comprised in the control system and device), or by a detected breach of the soldier's uniform or body armor (e.g., by a material damage sensor). The control system may then returns to the starting position.

Figure 4:
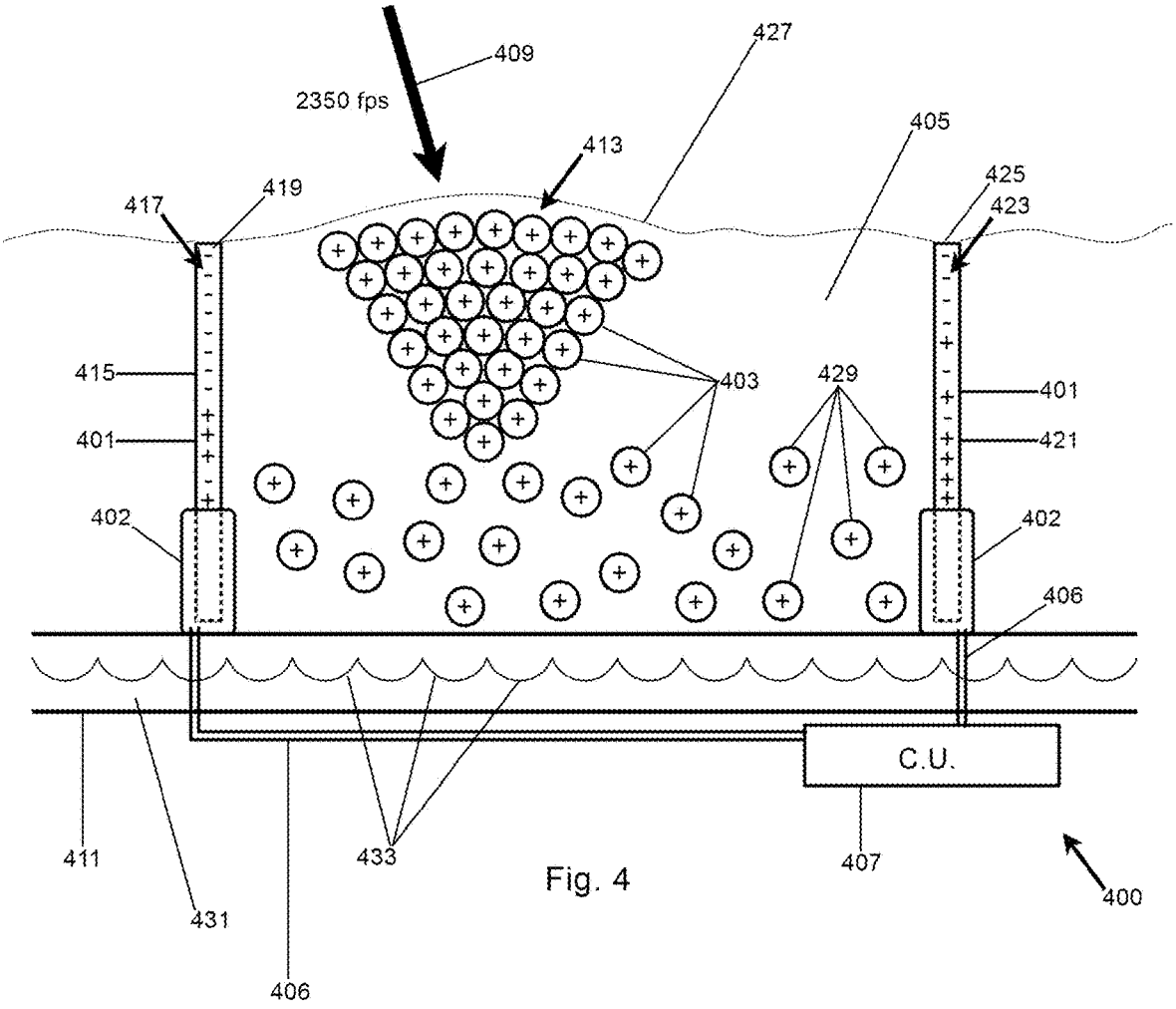
FIG. 4 is a cross-sectional view of an example of a new form of particle-controlling armor system, according to some embodiments.

FIG. 4 is a cross-sectional view of an example of a new form of particle-controlling armor system 400, according to some embodiments. In some embodiments, particle-controlling armor system 400 includes at least two electrostatic, magnetic and/or electromagnetic pins or plates 401, abutting at least one matrix of charged and/or ferromagnetic particles, such as the example charged and/or ferromagnetic particles 403. In some embodiments, charged and/or ferromagnetic particles 403 are suspended in a fluid, gel, gas, semi-solid material and/or space 405 placed between the at least two pins or plates 401. In some embodiments, a fluid, gel, gas and/or space 405 includes a suspension fluid or gel, such as propylene glycol. In some embodiments, charged and/or ferromagnetic particles 403 include a metal or other material suitable for absorbing forces from a projectile or weapon (especially when held by an electric, magnetic or electromagnetic field, as will be discussed in greater detail below. For example, in some embodiments, charged and/or ferromagnetic particles 403 include any, some or all of the following materials: a metal, iron, steel, nickel, titanium, a fabric, a woven fabric, KEVLAR, TWARON, DYNEEMA, CORDURA, nylon, carbon, carbon fiber, graphene, a ceramic, silk, a plastic, PET, high molecular weight PET, polyurea, gel-spun materials, and/or fibrous, layered and/or mesh and/or other structures. In some embodiments, charged and/or ferromagnetic particles 403 are microparticles. In some embodiments, charged and/or ferromagnetic particles 403 are nanoparticles. In some embodiments, charged and/or ferromagnetic particles 403 include microstructures. In some embodiments, charged and/or ferromagnetic particles 403 include nanostructures. In some embodiments, such structures, microstructures and/or nanostructures are curved (e.g., with a spherical surface, as pictured) to aid in diverting and absorbing kinetic energy from, projectiles and other weapons impacting particle-controlling armor system 400.

In some embodiments, particle-controlling armor system 400 includes a shear-thickening fluid or gel. In some embodiments, such a shear-thickening fluid increases solidity, strength and/or rigidity upon impact with a projectile or other weapon. In some embodiments, such a shear-thickening fluid increases solidity, strength and/or rigidity upon activation and/or increases in charge, applied to it (e.g., via pins or plates 401). In some embodiments, particle-controlling armor system 400 includes a colloid.

In some embodiments, pins or plates 401 are included within hardware (or in communication with hardware, e.g., through example wired connections 406) of a control system, such as example local control system 407 (included within particle-controlling armor system 400), which may include computer hardware and software, and may be, or include, a control system such as the example control system 400, set forth below. In some embodiments, pins or plates 401 may be held with fasteners 402, which may include physical and electrical contacts. As with embodiments discussed above, including shielding particles, in some embodiments, some or all of charged and/or ferromagnetic particles 403 may be moved based on a determination by a control system (namely, example local control system 407). For example, and again as with embodiments discussed above, including shielding particles, local control system 407 may include at least one sensor(s), configured to detect the presence, proximity and/or track the location of a projectile or other weapon. In some embodiments, local control system 407 may include other projectile and/or weapon tracking hardware and software, in addition to such at least one sensor(s). In some method embodiments of inventions set forth in the present application, control system may project a path of movement, and/or a potential path of movement and or threat of impact, by that projectile and/or weapon, such as the example projected path of a bullet shown by velocity-indicating arrow 409. In some such embodiments, control system 407 may then move charged and/or ferromagnetic particles 403 to a location on or about particle-controlling armor system 400 which will, or which is likely to, intercept that projectile and/or weapon, or reduce its force upon colliding with an armor backing 411, or a user, device or other valuable asset on the side of armor backing 411 opposite the projectile. In some such embodiments, charged and/or ferromagnetic particles 403 may be amassed in such a location (e.g., in example curve-shaped mass 413), and held there, by differential relative charge types and concentrations along each of electrostatic, magnetic and/or electromagnetic pins or plates 401. For example, as pictured, left-hand side pin or plate 415 may actuated by control system 407 by loading it with a high concentration of negative charge 417, and such a concentration of negative charge being especially dense toward its distal end 419. Also as an example, and as pictured, right-hand side pin or plate 421 may be actuated by control system 407 by loading it with a high concentration of negative charge 423 (albeit at a lower concentration of negative charge than concentration of negative charge 417, and such a concentration of negative charge again being more dense toward its distal end 425. As a result, charged and/or ferromagnetic particles 403, which may be positively charged particles, as pictured) are formed in curve-shaped mass 413 at the location pictured, on or about a distal surface 427 of fluid, gel, gas, semi-solid material and/or space 403, nearer to left-hand side pin or plate 415 than right-hand side pin or plate 421—namely, at such location. In some embodiments, when actuated by control system 407 and the pins and plates, charged and/or ferromagnetic particles may be held tightly together, as pictured in example curve-shaped mass 413, creating a more solid, resistant, projectile-proof material. Prior to such charges being created in such pins and plates by control system 407, however, charged and/or ferromagnetic particles held within fluid, gel, gas, semi-solid material and/or space 405 in a weaker, less resistant, more liquid, and/or more fluid configuration, as pictured for example randomly distributed charged and/or ferromagnetic particles 429. In some embodiments, armor backing 411 may include any suitable material for armor, such as any of the materials set forth above for interception media or particles. For example, in some embodiments, armor backing 411 includes armor plating.

In some such embodiments, armor backing 411 may include a plurality of materials. In some such embodiments, a first such material may be heavier, stronger, more resilient, denser and/or more flexible material than a second material within armor backing 411. For example, in some embodiments, such a first material may be an impact-resistant material 431. In some such embodiments, impact-resistant material 431 may be formed with a plurality of curved (e.g., spherical) surfaces 433 such that, if a projectile were to penetrate all the way through fluid, gel, gas, semi-solid material and/or space 405, at least one of the plurality of curved (e.g., spherical) surfaces 433 within armor backing 411 serve to turn the projectile, as it collides with those surfaces.

Figure 5:
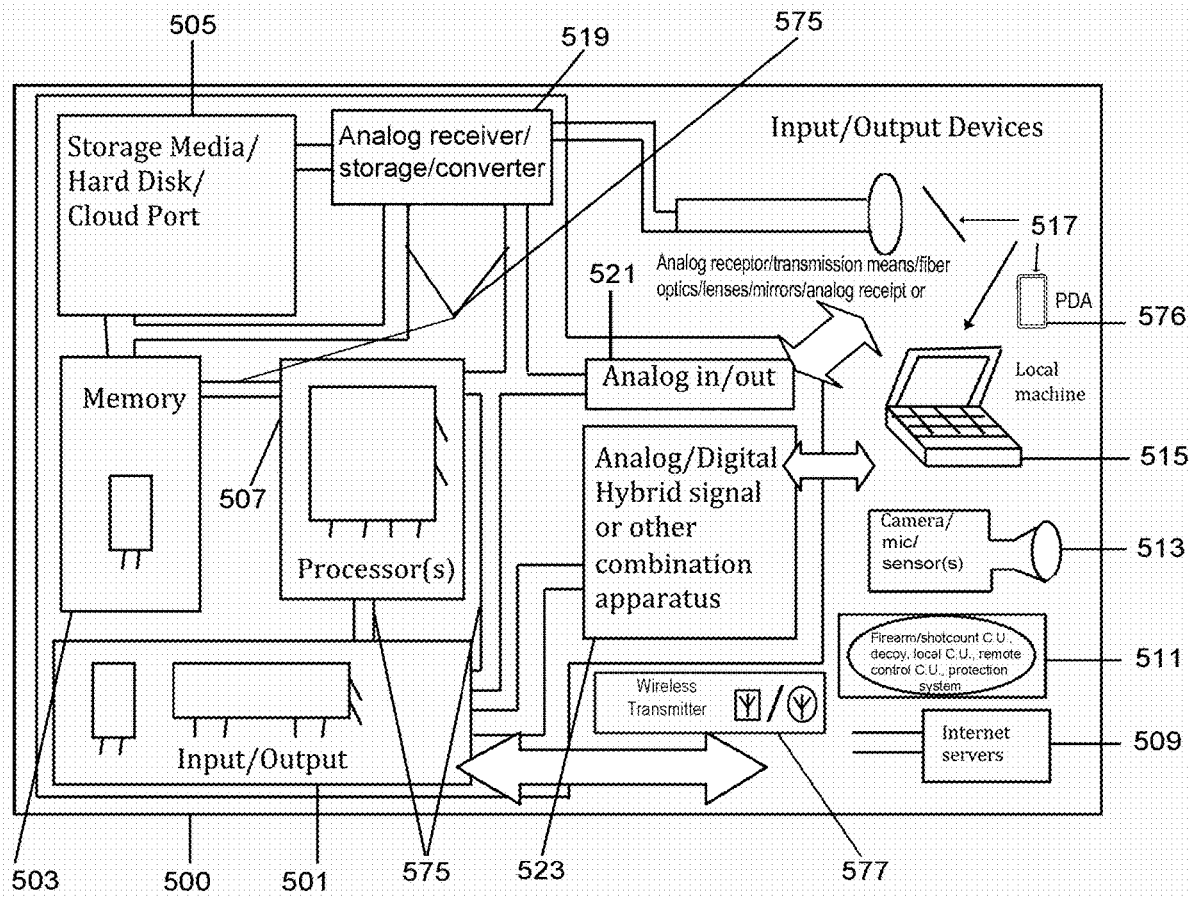
FIG. 5 is a schematic block diagram of some elements of an exemplary control system that may be used in accordance with aspects of the present invention.

FIG. 5 is a schematic block diagram of some elements of an exemplary control system 500 that may be used in accordance with aspects of the present invention, such as, but not limited to, controlling shot-counting and multiple magazine engagement systems, or controlling a projectile protection system and the deployment of interception media, or controlling gunfire decoy devices and remote control user interfaces. The generic and other components and aspects described herein are not exhaustive of the many different systems and variations, including a number of possible hardware aspects and machine-readable media that might be used, in accordance with the present invention. Rather, the system 500 is described to make clear how aspects may be implemented. Among other components, the system 500 includes an input/output device 501, a memory device 503, storage media and/or hard disk recorder and/or cloud storage port or connection device 505, and a processor or processors 507. The processor(s) 507 is (are) capable of receiving, interpreting, processing and manipulating signals and executing instructions for further processing and for output, pre-output or storage in and outside of the system. The processor(s) 507 may be general or multipurpose, single- or multi-threaded, and may have a single core or several processor cores, including, but not limited to, microprocessors. Among other things, the processor(s) 507 is/are capable of processing signals and instructions for the input/output device 501, analog receiver/storage/converter device 519, analog in/out device 521, and/or analog/digital or other combination apparatus 523 to cause a display, light-affecting apparatus and/or other user interface with active physical controls, such as indicator buttons and displays, and control actuation and other monitoring hardware, any of which may be comprised or partially comprised in a Graphical User Interface ("GUI"), to be provided for use by a user on hardware, such as a specialized personal computer monitor, remote control device or Personal Digital Assistant ("PDA") or control unit screen (including, but not limited to, monitors or touch- and gesture-actuable displays) or a terminal monitor with a mouse and keyboard or other input hardware and presentation and input software (as in a software application GUI), and/or other physical controls, such as buttons, sliders, knobs, LEDs or LCDs. Alternatively, or in addition, the system, using processors 507 and input/output devices 519, 521 and/or 523, may accept and exert passive and other physical (e.g., tactile) user, power supply, appliance operation, user activity, circuit and environmental input (e.g., from sensors) and output.

For example, and in connection with aspects of the invention discussed in reference to other figures set forth in the present application, the system may carry out any aspects of the present invention as necessary with associated hardware and/or using specialized software, including, but not limited to, controlling actuators (e.g., selecting, aiming, and activating an interception media actuator, such as example interception media actuation unit(s) 123, discussed above) for controlling projectile and weapon interception media, and operating wired and/or wireless communications hardware to establish control over them. As another example, in some embodiments, the system may carry out any of the methods set forth in this application related to detecting the presence of and tracking the location, flight path, and potential impact(s) of projectiles. In some embodiments, the system may, among many other things described for control systems in this application, respond to user, sensor and other input (for example, by a user-actuated GUI controlled by computer hardware and software or by another physical control) to issue alerts, alter settings (such as perimeter distances, sound volumes and source proximities), control alarms and alerts associated with operative conditions, authenticate users or remote control devices and give and receive instructions and commands to other devices and users, or perform any other aspect of the invention requiring or benefiting from use of a control system. In some embodiments, the system may carry out any such methods based on specialized programming, including routines for so carrying out any of the methods set forth in this application. In some embodiments, the system 501 may permit the user and/or system-variation of settings, including but not limited to the effects of user activity on modes of operation of the system, and send external alerts and other communications (for example, to users or other administrators) via external communication devices, for any control system, remote control or other control unit aspect that may require or benefit from such external or system-extending communications.

The processor(s) 507 is/are capable of processing instructions stored in memory devices 503 and/or 505 (and/or ROM or RAM), and may communicate with any of these, and/or any other connected component, via system buses 575. Input/output device 501 is capable of input/output operations for the system, and may include/communicate with any number of input and/or output hardware, such as a computer mouse, keyboard, entry pad, actuable display, networked or connected second computer or processing device, control unit, other GUI aspects, camera(s) or scanner(s), sensor(s), microphone(s), sensor/motor(s), actuable electronic components (with actuation instruction receiving and following hardware), RF antennas, other radiation, wave or electrical characteristics reading, monitoring, storage and transmission affecting hardware, as discussed in this application, range-finders, GPS systems, receiver(s), transmitter(s), transceiver(s), transflecting transceivers ("transflecters" or "transponders"), antennas, electromagnetic actuator(s), mixing board, reel-to-reel tape recorder, external hard disk recorder (solid state or rotary), additional hardware controls (such as, but not limited to, buttons and switches, and actuators, current or potential applying contacts and other transfer elements, light sources, speakers, additional video and/or sound editing system or gear, filters, computer display screen or touch screen. It is to be understood that the input and output of the system may be in any useable form, including, but not limited to, signals, data, commands/instructions and output for presentation and manipulation by a user in a GUI. Such a GUI hardware unit and other input/output devices could, among other things, implement a user interface created by non-transitory machine-readable means, such as software, permitting the user to carry out any of the user settings, commands and input/output discussed above, and elsewhere in this application.

In some embodiments, input/output device 501, memory device 503, storage media and/or hard disk recorder and/or cloud storage port or connection device 505, processor or processors 507, analog receiver/storage/converter device 519, analog in/out device 521 and analog/digital or other combination apparatus 523 are connected and able to communicate communications, transmissions and instructions via system busses 575. Storage media and/or hard disk recorder and/or cloud storage port or connection device 505 is capable of providing mass storage for the system, and may be a computer-readable medium, may be a connected mass storage device (e.g., flash drive or other drive connected to a U.S.B. port or Wi-Fi) may use back-end (with or without middle-ware) or cloud storage over a network (e.g., the internet) as either a memory backup for an internal mass storage device or as a primary memory storage means, and/or may be an internal mass storage device, such as a computer hard drive or optical drive.

Generally speaking, the system may be implemented as a client/server arrangement, where features of the invention are performed on a remote server, networked to the client and facilitated by software on both the client computer and server computer. Input and output devices may deliver their input and receive output by any known means of communicating and/or transmitting communications, signals, commands and/or data input/output, including, but not limited to, input through the devices illustrated in examples shown as 517, such as 509, 511, 513, 515, 576 and 577 and any other devices, hardware or other input/output generating and receiving aspects—e.g., a PDA networked to control a control unit 477 with the aid of specialized software (a.k.a. a "PDA Application" or "App."). Any phenomenon that may be sensed may be managed, manipulated and distributed and may be taken or converted as input or output through any sensor or carrier known in the art. In addition, directly carried elements (for example a light stream taken by fiber optics from a view of a scene) may be directly managed, manipulated and distributed in whole or in part to enhance output, and radiation or whole ambient light or other radio frequency ("RF") information for an environmental region may be taken by a photovoltaic apparatus for battery cell recharging if battery power is included as the power source for the control system, or sensor(s) dedicated to angles of detection, or an omnidirectional sensor or series of sensors which record direction as well as the presence of electromagnetic or other radiation. While this example is illustrative, it is understood that any form of electromagnetism, compression wave or other sensory phenomenon may become such an "ambient power" source harnessed to power the operations of a control unit and/or control system and/or may include such sensory directional and 3D locational or other operations-identifying information, which may also be made possible by multiple locations of sensing, preferably, in a similar, if not identical, timeframe. The system may condition, select all or part of, alter and/or generate composites from all or part of such direct or analog image or other sensory transmissions, including physical samples (such as DNA, fingerprints, iris, and other biometric samples or scans) and may combine them with other forms of data, such as image files, dossiers, appliance-identifying files, or operations-relevant recordings, or metadata, if such direct or data encoded sources are used. In addition to keys, codes entered into a GUI, fob, remote control or beacon signals, authentication aspects of the present invention may also or alternatively be carried out with biometric challenge and detection hardware, such as fingerprint, iris, DNA or other pattern scans.

While the illustrated system example 500 may be helpful to understand the implementation of aspects of the invention, it should be understood that any form of computer system may be used to implement many control system and other aspects of the invention—for example, a simpler computer system containing just a processor (datapath and control) for executing instructions from a memory or transmission source. The aspects or features set forth may be implemented with, as alternatives, and/or in any combination, digital electronic circuitry, hardware, software, firmware, or in analog or direct (such as electromagnetic wave-based, physical wave-based or analog electronic, magnetic or direct transmission, without translation and the attendant degradation, of the medium) systems or circuitry or associational storage and transmission, any of which may be aided with enhancing media from external hardware and software, optionally, by wired or wireless networked connection, such as by LAN, WAN or the many connections forming the internet or local networks. The system can be embodied in a tangibly-stored computer program, as by a machine-readable medium and propagated signal, for execution by a programmable processor. The method steps of the embodiments of the present invention also may be performed by such a programmable processor, executing a program of instructions, operating on input and output, and generating output. A computer program includes instructions for a computer to carry out a particular activity to bring about a particular result, and may be written in any programming language, including compiled and uncompiled, interpreted languages, assembly languages and machine language, and can be deployed in any form, including a complete program, module, component, subroutine, or other suitable routine for a computer program.

I claim:

1. A shielding system for blocking projectiles and weapons, comprising:

interception media located on or about a housing of said shielding system;

at least one actuator, configured to move at least part of said interception media;

at least one sensor, configured to sense an impending threat of a projectile or other impact;

a control system, configured to control said at least one actuator; and armor and/or other hardware;

wherein said control system and said at least one actuator are configured to move said at least part of said interception media to a planned interception location within or between said armor and/or other hardware, where said interception media intercepts said projectile or prevents said other impact based on said at least one sensor sensing said impending threat of a projectile or other impact.

2. The shielding system of claim 1, wherein said interception media comprises a plurality of shielding particles, wherein said shielding particles form, and/or aid in forming or reinforcing, a barrier configured to absorb at least a portion of a force of the projectile or other impact when said actuator moves said interception media.

3. The shielding system of claim 1, comprising at least one electromagnet, configured to be activated based on said impending threat of a projectile or other impact.

4. The shielding system of claim 2, comprising at least one electromagnet, configured to be activated based on said impending threat of a projectile or other impact.

5. The shielding system of claim 4, wherein said particles comprise a ferromagnetic material.

6. The shielding system of claim 1, wherein said interception media comprises a sheet of material.

7. The shielding system of claim 6, wherein said interception media comprises any, some or all of the following materials: a metal, iron, steel, nickel, titanium, a fabric, a woven fabric, KEVLAR, TWARON, DYNEEMA, CORDURA, nylon, carbon, carbon fiber, graphene, a ceramic, silk, a plastic, PET, high molecular weight PET, polyurea, gel-spun materials, and/or fibrous, layered and/or mesh and/or other structures.

8. The shielding system of claim 2, wherein said particles comprise any of the following materials: metal, iron, steel, nickel, titanium, a fabric, a woven fabric, an aramid, nylon, carbon, carbon fiber, graphene, a ceramic, silk, a plastic, polyethylene, high molecular weight polyethylene, polyurea, gel-spun materials, fibrous structures, layered structures, mesh structures and other structures.

9. The shielding system of claim 1, comprising a weapon detecting subsystem, and wherein said weapon detecting subsystem is configured to sense said impending threat of a projectile or other impact.

10. The shielding system of claim 9, wherein said projectile and/or weapon detecting subsystem comprises a ballistic computer, configured to project a path of said projectile and/or weapon.

11. The shielding system of claim 1, wherein said at least one actuator is configured to move at least some of said interception media toward at least one point(s) selected by said control system and/or a user of said control system.

12. The shielding system of claim 11, wherein said at least one point(s) are on or about a piece of said armor and said housing.

13. The shielding system of claim 1, wherein said at least one actuator comprises at least one propellant, configured to be activated based on said sensing of said impending threat of a projectile or other impact.

14. The shielding system of claim 1, wherein said interception media comprises a plurality of charged ferromagnetic particles, wherein said charged ferromagnetic particles form a barrier configured to absorb at least a portion of a force of the projectile or other impact when said actuator moves said interception media.

15. The shielding system of claim 14, wherein said actuator comprises one or more chargeable plates, and wherein said plurality of charged ferromagnetic particles are moved by said actuator, to absorb said at least a portion of a force of the projectile or other impact when said actuator moves said interception media.

16. A method for blocking projectiles and weapons, comprising the following steps:

obtaining a shielding system for blocking projectiles and weapons, comprising:

interception media located on or about a housing of said shielding system;

at least one actuator, configured to move at least part of said interception media;

at least one sensor, configured to sense impending threat(s) of a projectile(s) or other impact(s);

a control system, configured to control said at least one actuator; and armor and/or other hardware;

wherein said control system and said at least one actuator are configured to move said at least part of said interception media to a planned interception location within or between said armor and/or other hardware, where said interception media intercepts said projectile or prevents said other impact based on said at least one sensor sensing said impending threat(s) of a projectile(s) or other impact(s).

17. The method for blocking projectiles and weapons of claim 16, comprising the following additional step:

activating said shielding system.

18. The method for blocking projectiles and weapons of claim 16, comprising the following additional step:

sensing an impending threat of a projectile or other impact.

19. The method for blocking projectiles and weapons of claim 18, comprising the following additional step:

moving at least part of said interception media to protect against said projectile or other impact.

20. The shielding system of claim 2, wherein said shielding particles are suspended in a fluid, gel, gas, or semi-solid material.

* * * * *